United States Patent [19]

Andrews

[11] Patent Number: 5,037,057

[45] Date of Patent: Aug. 6, 1991

[54] COLLAPSIBLE MUSIC STAND

[76] Inventor: Kim N. Andrews, 6627 Burnet Ave., Van Nuys, Calif. 91405

[21] Appl. No.: 462,781

[22] Filed: Jan. 10, 1990

[51] Int. Cl.[5] ..... A47B 97/00

[52] U.S. Cl. ..... 248/460; 248/448; 248/441.1

[58] Field of Search ..... 248/460, 461, 441.1, 248/448, 176; 108/102; 211/175, 43

[56] References Cited

U.S. PATENT DOCUMENTS

| | | | |
|---|---|---|---|
| 575,729 | 1/1897 | Palmer | 248/448 |
| 2,474,532 | 6/1949 | Kitchen | 248/461 X |
| 3,637,172 | 1/1972 | Diesbach | 248/460 |
| 4,312,490 | 1/1982 | Biasini | 248/441.1 X |
| 4,372,518 | 2/1983 | Biasini | 248/441.1 |
| 4,606,525 | 8/1986 | Lombardi | 248/460 |
| 4,610,417 | 9/1986 | Kuss | 248/460 |
| 4,754,945 | 7/1988 | Diamond | 248/460 |

*Primary Examiner*—Karen J. Chotkowski

*Attorney, Agent, or Firm*—Jack C. Munro

[57] ABSTRACT

A collapsible swing-out extendible music stand capable of tilting and holding multiple sheets or books simultaneously on a vertical shaft and foldable tripod base. The upper section is a backrest consisting of plates connected by vertical hinges attached to folding shelf segments by horizontal hinges. The outermost plates may be used individually or in tandem being secured to the back of the primary plates by fastening devices, when not in use. A handle is mounted on the front of the center plate for carrying. A pivot device on the reverse side allows tilting of the backrest. A vertical shaft within a shaft and tensioning device permits height adjustment. In the second embodiment the outermost plates fold opposite toward the front, and are without attached shelves. The additional shelf panels are hinged to and folded beneath the main shelves, secured by fastening devices. When in use, the shelf panels are attached by locking device to the extended outermost plate.

2 Claims, 3 Drawing Sheets

FIG. 1
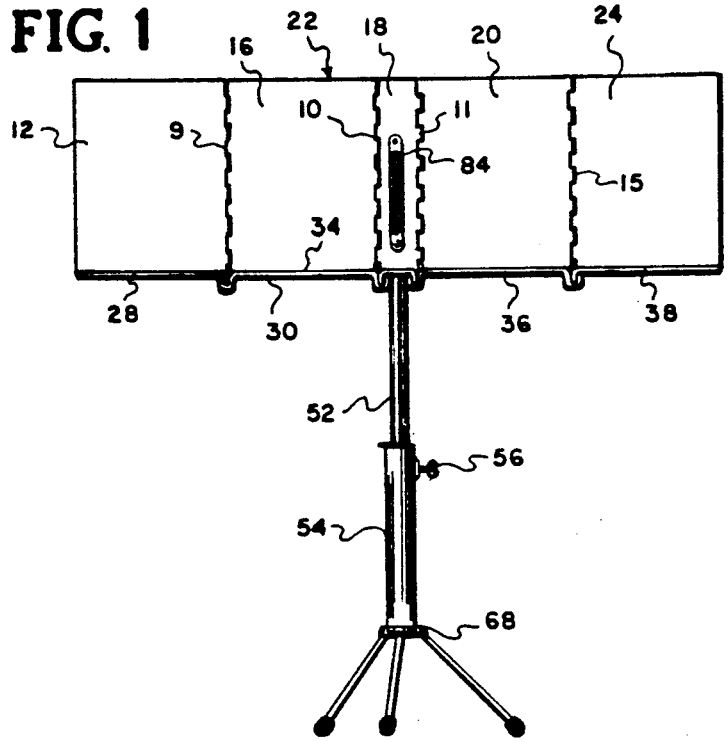
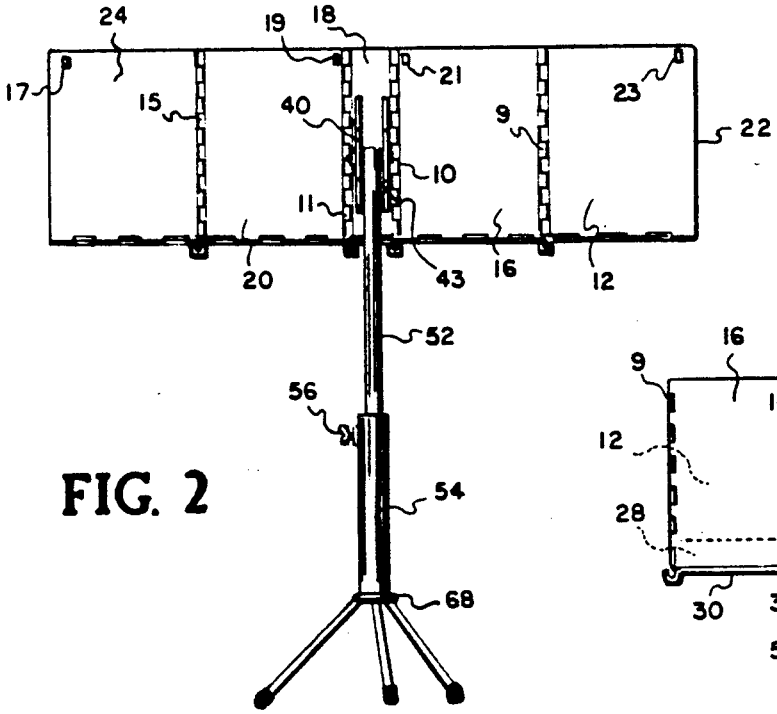
FIG. 2
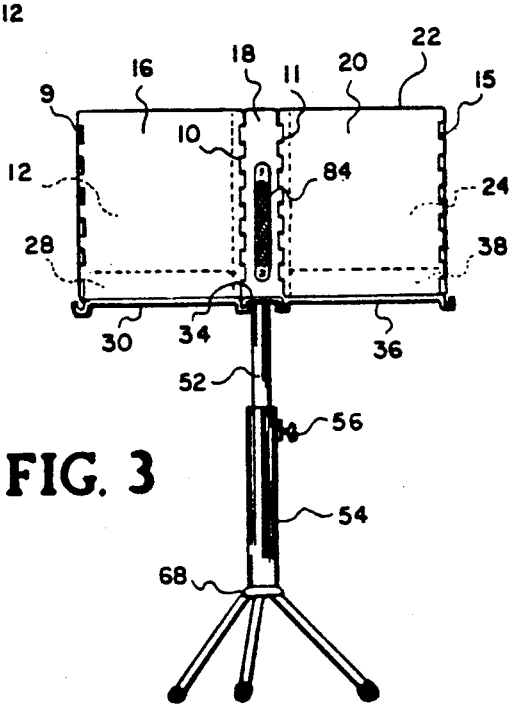
FIG. 3

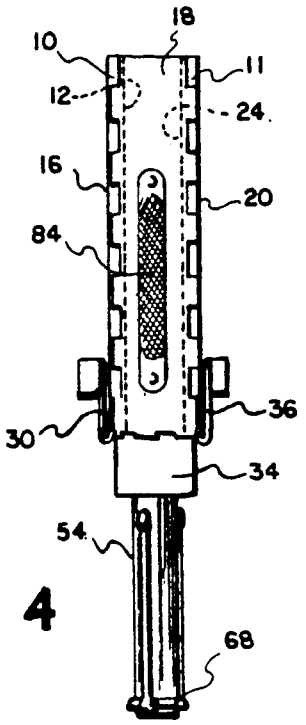
FIG. 4
FIG. 5
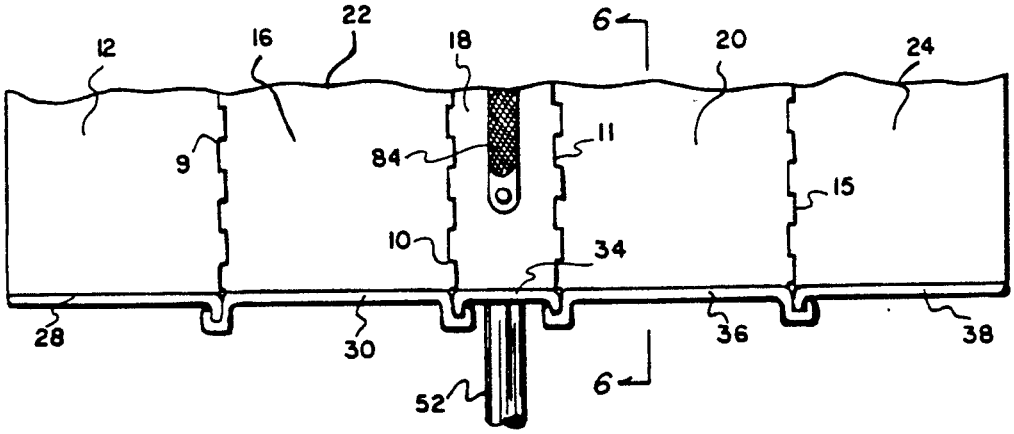
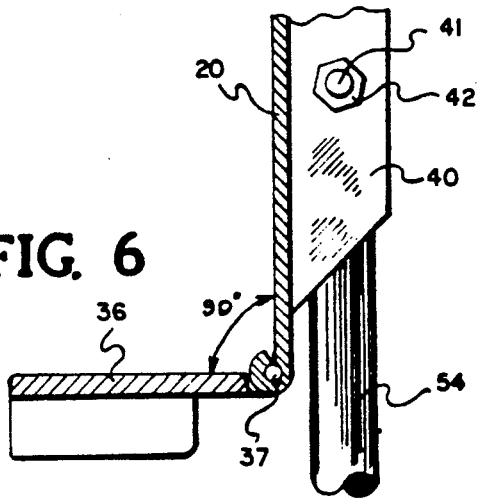
FIG. 6

COLLAPSIBLE MUSIC STAND

BACKGROUND OF THE INVENTION

This invention relates to collapsible music stands incorporating an upper section of a solid, tilting backrest, an adjustable support shaft attached vertically, and a foldable tripod base.

Conventional music stands consist of a solid backrest and shelf with a width of just over two pages to fulfill the transporting and reading requirements of the professional musician. After loading instruments, amplifiers, and speakers, there is little remaining space in ever smaller automobiles for this size of backrest configuration. The alternative is to use a music stand with a wire backrest, but these are flimsy under weight and when outdoors, wind blowing through them causes the pages to fall; an undesirable exchange for the sake of portability.

The backrest, being fixed and limited in width causes endless page turnings and disruptive pauses to the musician and audience alike. A more panoramic view is necessary for conducting as well. During live recordings, these page turnings may be picked up by the microphone and become part of the subsequent recordings. To compensate for the lack of width entails purchasing and transporting multiple music stands, placing them side by side as space allows or buying additional clip on panels, which are less secure and worse yet, may be forgotten entirely, when loading.

One type of collapsible music stand is seen in U.S. Pat. No. 864,066, Berwick, which folds to a sachel form with a handle to carry the music within the transported form. The sachel is placed and opened on a music rack, and the music is held in place by spring plates for the proper tension.

U.S. Pat. No. 2,808,221, Elsbernd, shows a knockdown display structure wherein a plurality of panels are hinged together and provided with interlocking means to hold the panels in open operative edge aligned position and an intermediate leg providing an easel-like structure.

U.S. Pat. No. 3,596,866, Baker discloses a portable carrying case which when closed serves to store an attached music stand and when partly open provides a base. It comprises upper and lower boxlike sections hinged together.

In the music stand extender of U.S. Pat. No. 4,312,490, Biasini, a pair of extension members especially adapted to be slidably affixed to the book support member of a music stand of conventional construction is illustrated. The extension panels have provided thereon a plurality of retaining members, defining a retaining groove, sliding onto the music stand.

U.S. Pat. No. 4,605,193, Kuparinen, shows a foldable music stand comprised of a lectern, which includes a backplate and a shelf, a vertical shaft, and a &holding support member, against which backplate a score is placed to rest on the shelf, when the lectern is in operation; the shelf and backplate can be folded against each other when transporting parallel to a movable cross leg to form a platelike flat object.

While all of these function as described, there remains a need for a complete music stand, one with a sturdy, yet collapse backrest, shelf and base that is easily manufactured; and a self-contained means of adjusting the width of the backrest and shelf quickly and easily, indoors or outdoors, as the performance demands.

SUMMARY OF THE INVENTION

The present invention recognizes the difficulties listed above and solves them by incorporating a series of solid swing-out plates diVided by vertical hinges to form a backrest. The shelf is hinged horizontally by segments allowing it to collapse parallel to the folding backrest plates. Interlocking devices on the ends of each shelf segment secure one to another, as the upper section opens to the desirable width. The outermost plates are fastened to the back of the primary plates, out of the way, until called upon.

On one side of the center plate, a pivot means is attached for tilting the backrest, and on the front, a carrying handle. A vertical shaft within a shaft, with tensioning device, permits height adjustment, and a tripod base completes fold-up capability.

A second embodiment allows the outermost plates to swing opposite, toward the front, without attached shelves. The necessary shelves are hinged to the primary shelves and are secured to the underside by locking devices; in the operating position they fold outward and fasten to the back of the outermost plates.

Benefits of the present invention include collapsibility of the solid backrest while maintaining maximum sturdiness and dependability, when in use inside or outdoors. Another feature, the self-contained swing-out plates, allow the width to be easily increased in either direction, or both simultaneously, for a panoramic view without the use of duplicate music stands or attachments. Additionally, the pivot means permits varied positions of the folded upper section to assist in loading. A further feature, the carrying handle, offers handling ease when transporting.

BRIEF DESCRIPTION OF THE DRAWINGS

In the drawings of the invention, like reference characters designating like parts throughout the same:

FIG. 1 is a front view of the fully extended music stand of the present invention;

FIG. 2 is a back view, fully extended, showing fasteners on the plates;

FIG. 3 is a front view of the partially collapsed music stand;

FIG. 4 is a front view of the music stand in the totally collapsed position which is the transport position where the locking device 56 is pivoted to not be observable.

FIG. 5 is an enlarged view of the interlocking devices that secure to one another, from the front;

FIG. 6 is a side view of the shelf with interlockinq device, backrest, pivot means, and vertical shaft;

DESCRIPTION OF THE PREFERRED EMBODIMENT

Figure 7:
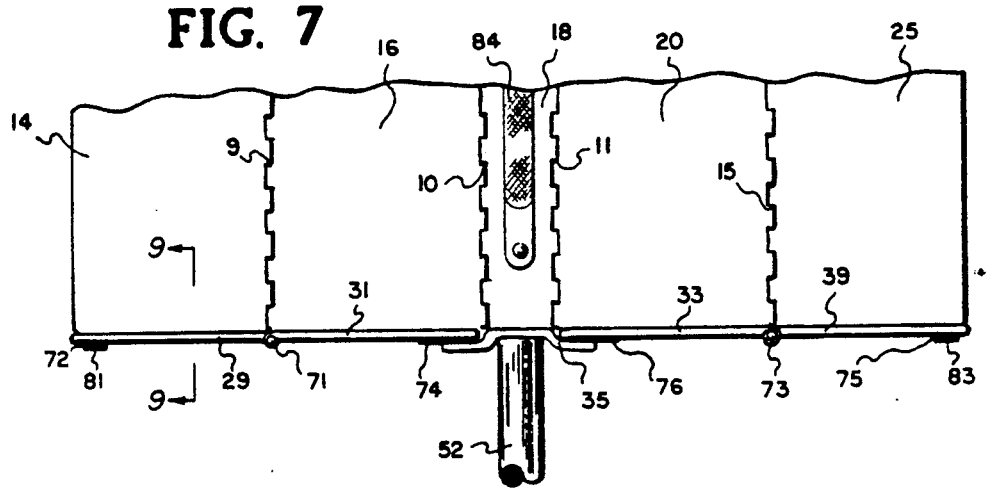
FIG. 7 is an enlarged front view of the second embodiment, fully extended.

Referring now to the drawings in detail, the preferred form of the collapsible music stand in accordance with the principles of the present invention, consists of an entire backrest 22, comprised of a series of plates connected by vertical hinges.

The backrest 22 is formed by plates 12, 16, 20, 24, being connected by vertical hinges 9, 10, 11, 15, to a fixed center plate 18 to which all plates fold toward. Carrying handle 84 is attached to the front middle section of center plate 18.

The shelf segments 28, 30, 34, 36, 38, are connected to the corresponding plates 12, 16, 18, 20, 24, respectively by horizontal hinge segments 37, collapsing parallel to the backrest 22 and perpendicular in the operating position.

Supports 40, 43, are attached to the back of center plate 18 on one edge; the remaining edge is drilled through as is vertical shaft 52, allowing bolt 41 to pass through supports 40, 43, and vertical shaft 52 to be secured by nut 42. This connection allows tilting of the backrest 22 while mounted on vertical shaft 52. Vertical shaft 52 is inserted into the larger diameter shaft 54 and is locked into the preferred height by locking device 56. Tripod 68 attached to vertical shaft 54 permits the base to be collapsed as well.

FIG. 5 shows the shelf connections with the interlocking devices enabling each shelf to lock one another into place. On the end of each shelf segment 28, 30, 34, 36, 38, is one half of an interlocking device which when coupled with the adjoining half fits together in a dowel-like manner. ( Alternately, slide bolts or other securing means from the center plate 18 across the adjoining vertical hinges 10, 11, securing to the primary plates 16, 20, and the same means for securing the outermost plates 12, 24, could be used in place of the interlocking devices on the shelf segments to retain sturdiness when in the operating position. ) The interlocking devices prevent the backrest 22 from folding on hinges 10, 11, and strengthen the shelf segments while ensuring uniformity.

Collapsing of the present invention from the fully extended position ( FIGS. 1, 2 ) begins by lifting shelf segment 28 parallel to plate 12 which releases it from shelf 30 allowing plate 12 to pivot on hinge 9 behind plate 16 attaching fastener 23 to fastener 21. Shelf segment 38 is lifted allowing plate 24 to pivot on hinge 15 behind plate 20 and attaches fastener 17 to fastener 19, as completed in FIG. 3. Shelf 34 is lifted releasing shelf 30, 36 to be lifted parallel to plates 16, 20, which then pivot on hinges 10, 11, to become perpendicular to center plate 18. Downward motion on plate 18 pivots it to the horizontal position in FIG. 4. Loosening locking device 56 allows vertical shaft 52 to move downward into shaft 54, and folding tripod 68 completes maximum collapsibility as in FIG. 4. Lifting carrying handle 84 makes transporting of the collapsed music stand easy.

Figure 8:
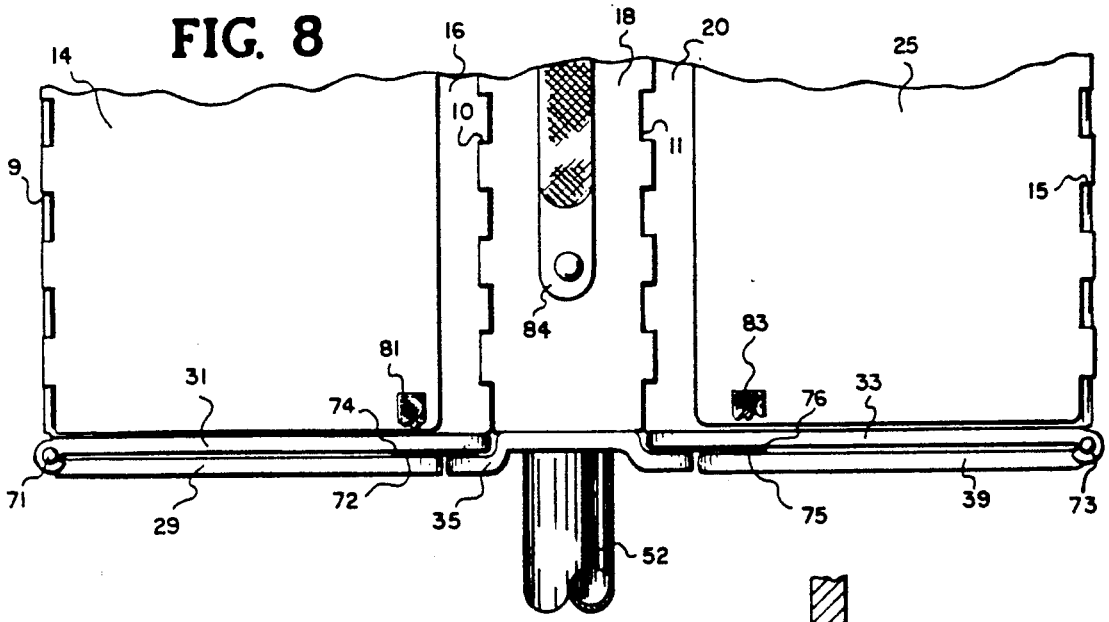
FIG. 8 is a partially collapsed front view of the second embodiment.
Figure 9:
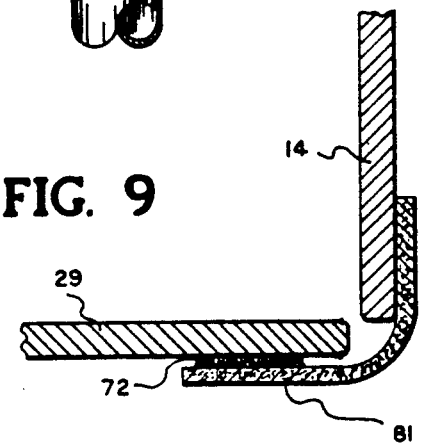
FIG. 9 is a side view of the outermost shelf secured by fastener to the outermost plate.

In the second embodiment ( FIGS. 7, 8, 9, ) female loop fastener 72 is released from male hook fastener 81. Fastener 81 comprises a flexible strap one of which is permanently affixed to plate 14 with the opposite free end including a male hook section. Typical material for fastener 72 and 81 would be what is commonly sold under the tradename of Velcro. Shelf 29, which is attached to shelf 31 by horizontal hinge 71, folds (counter-clockwise in FIG. 7) until fastener 72 secures to a portion of male hook fastener 74. Plate 14, without an attached shelf, pivots forward to rest parallel on the front surface of plate 16. Likewise, fastener 75 releases from fastener 83 and pivots on hinge 73 to position shelf 39 below shelf 33 securing fastener 75 to fastener 76. This allows p ate 25 to pivot forward parallel rest on the front surface of to plate 20. Shelf 31 is lifted from shelf 35 and plate 16 pivots backwards perpendicular to center plate 18 for transport, plate 20 moves likewise as shelf 33 is lifted from shelf 35.

A further feature of both forms of this invention enables the tripod of one folded music stand to be inserted into the collapsed backrest 22 of another to require less space when transporting more than one music stand.

What is claimed is:

1. A collapsible stand comprising:

a center plate having a pair of opposite sides, said center plate having a planar front surface;

a first primary plate hingedly joined to one of said sides, a second primary plate hingedly joined to the other of said sides, each said primary plate being independently movable on said center plate between a usable position and a transport position, said primary plates being in alignment with said planar front surface when in said usable position, said primary plates being in juxtaposition when in said transport position, said primary plates having substantially the same width;

a first outermost plate hingedly movable connected to said first primary plate, a second outermost plate hingedly movably connected to said second primary plate, each said outermost plate having a width less than the said primary plate to which it is connected, each said outermost plate being independently movable on its respective said primary plate between a usable position and a transport position, said outermost plates being aligned with said primary plates when in said usable position, each said outermost plate to be located in juxtaposition with its respective said primary plate when in said transport position, locking means connected to each said outermost plate for securing each said outermost plate to its respective said primary plate when said outermost plates are in said transport position;

said central plate and said primary plates and said outermost plates all having a lower edge that are in substantial horizontal alignment, a first shelf segment hingedly mounted on said lower edge of said first primary plate, a second shelf segment hingedly mounted on said lower edge of said second primary plate, a third shelf segment hingedly mounted on said lower edge of said first outermost plate, a fourth shelf segment hingedly mounted on said lower edge of said second outermost plate, each said shelf segment being movable on its respective said plate between an operating position and a parallel position, said operating position being substantially perpendicular to said planar front surface of said center plate, said parallel position being when each said shelf segment is located in juxtaposition to its respective said plate on which it is mounted, said shelf segments being interlockingly connected together when in said operating position;

a vertical shaft assembly of a plurality of shafts connected together by locking devices for height adjustment, one of said shafts being pivotally connected to said center plate in a manner to permit inclination of said center plate relative to said vertical shaft assembly;

a collapsible tripod base secured to said vertical shaft assembly; and a carrying handle mounted on said center plate for transport.

2. The collapsible stand comprising:

a center plate having a pair of opposite sides, said center plate having a planar front surface;

a first primary plate hingedly joined to one of said sides, a second primary plate hingedly joined to the other of said sides, each said primary plate hingedly joined to the independently movable on said center plate between a usable position and a transport position, said primary plates being in alignment with said planar front surface when in said usable position, said primary plates being in juxtaposition when in said transport position;

a first outermost plate hingedly movably connected to said first primary plate, a second outermost plate hingedly movably connected to said second primary plate, each said outermost plate having a width less than the said primary plate to which it is connected, each said outermost plate being independently movable on its respective said primary plate between a usable position and a transport position, said outermost plates being aligned with said primary plates when in said usable position, each said outermost plate to be located in juxtaposition with its respective said primary plate when in said transport position, locking means connected to each said outermost plate for securing each said outermost plate to its respective said primary plate when said outermost plates are in said transport position;

said center plate and said primary plates and said outermost plates all having a lower edge that are in substantial horizontal alignment, a first shelf segment hingedly mounted on said lower edge of said first primary plate, a second shelf segment hingedly mounted on said lower edge of said second primary plate, a third shelf segment hingedly mounted on said lower edge of said first shelf segment, a fourth shelf segment hingedly mounted on said lower edge of said second shelf segment, each said shelf segment being movable on its respective said plate between an operating position and a parallel position, said operating position being when said shelf segments are substantially perpendicular to said planar front surface of said center plate said parallel position being when said first and said third shelf segments are located in juxtaposition to said first primary plate and when said second and said fourth shelf segments are located in juxtaposition to said second primary plate, first locking means securing said third shelf segment to said first shelf segment when in said transport position, a second locking means securing said fourth shelf segment to said second shelf segment when in said transport position;

a vertical shaft assembly of a plurality of shafts connected together by locking devices for height adjustment, one of said shafts being pivotally connected to said center plate in a manner to permit inclination of said center plate relative to said vertical shaft assembly;

a collapsible tripod base secured to said vertical shaft assembly; and a carrying handle mounted on said center plate for transport.

* * * * *